US009103137B2

(12) United States Patent
Williams

(10) Patent No.: US 9,103,137 B2
(45) Date of Patent: Aug. 11, 2015

(54) SHELTER SUPPORT SYSTEM

(76) Inventor: Marty Williams, Colorado Springs, CO (US)

( * ) Notice: Subject to any disclaimer, the term of this patent is extended or adjusted under 35 U.S.C. 154(b) by 147 days.

(21) Appl. No.: 13/523,875

(22) Filed: Jun. 14, 2012

(65) Prior Publication Data

US 2013/0333737 A1 Dec. 19, 2013

(51) Int. Cl.

| | |
|---|---|
| ***E04H 15/36*** | (2006.01) |
| ***E04H 15/18*** | (2006.01) |
| ***E04H 15/40*** | (2006.01) |
| ***E04H 6/00*** | (2006.01) |
| ***E04H 15/06*** | (2006.01) |

(52) U.S. Cl.

CPC ..... *E04H 15/18* (2013.01); *E04H 6/005* (2013.01); *E04H 15/06* (2013.01); *E04H 15/40* (2013.01)

(58) Field of Classification Search

CPC ..... E04H 15/18; E04H 15/36; E04H 15/42; E04H 15/58; E04H 15/56; E04H 15/425; E04H 2015/326; E04H 15/06; E04H 15/32; E04H 15/40; E04H 15/64; E04H 1015/326; E04H 6/005

USPC ..... 135/88.09, 88.15, 95–97, 121, 135/123–124, 127, 136, 137, 138, 156–157, 135/119, 120.3; 296/159, 161, 163

See application file for complete search history.

(56) References Cited

U.S. PATENT DOCUMENTS

| | | | | | |
|---|---|---|---|---|---|
| 3,812,616 | A * | 5/1974 | Koziol | 52/63 |
| 4,091,584 | A * | 5/1978 | Brown | 135/127 |
| 4,404,980 | A * | 9/1983 | Wade | 135/123 |
| 4,815,490 | A * | 3/1989 | Soderstrom | 135/97 |
| 4,979,532 | A * | 12/1990 | Johansson et al. | 135/97 |
| 5,394,897 | A * | 3/1995 | Ritchey et al. | 135/124 |
| 5,546,971 | A * | 8/1996 | Leonhardt | 135/127 |
| 5,595,203 | A * | 1/1997 | Espinosa | 135/124 |
| 6,145,525 | A * | 11/2000 | Mooney | 135/119 |
| D574,918 | S * | 8/2008 | McAlister | D21/834 |
| 8,453,664 | B2 * | 6/2013 | Parsons et al. | 135/127 |
| 2009/0032078 | A1 * | 2/2009 | Gardiner et al. | 135/97 |

FOREIGN PATENT DOCUMENTS

| | | | | |
|---|---|---|---|---|
| DE | 10227999 | A1 * | 1/2004 | E04H 15/36 |
| FR | 2696774 | A1 * | 4/1994 | E04H 15/30 |
| GB | 2325256 | A * | 11/1998 | E04H 15/40 |

* cited by examiner

*Primary Examiner* — Winnie Yip
(74) *Attorney, Agent, or Firm* — Tracy M. Heims; Alex Juris, pllc

(57) ABSTRACT

A shelter system including a base assembly and a flexible support assembly where the base assembly has two legs that are held together by at least two tension straps and the where the flexible support assembly has flexible support members and spanning poles and where the flexible support members of the flexible support assembly are securely attached to the base assembly at each end of the base system legs and where the entire flexible support assembly is then erected and covered, creating a self standing shelter system.

17 Claims, 16 Drawing Sheets

SHELTER SUPPORT SYSTEM

FIELD OF THE INVENTION

This invention relates to the field of shelter and other tent structures.

BACKGROUND OF THE INVENTION

Tents and shelters are used for a wide variety of purposes ranging from camping, to storage, to day use shelters, to commercial purposes and many other purposes. Each use typically requires a particular size, shape and configuration. For example, a camping tent may range from a small backpacking tent to a larger expedition tent to a multiple person family style tent. A backpacking tent may include two or more support poles that are supported together by tent materials and tensioning cords. A larger expedition tent may require multiple poles that require tensioning cords. The structures that support these tents are relatively complex to assemble and are not free-standing without the tent covers and/or tensioning cords. The larger family style tents and even commercial shelters require multiple components and the use of tension cords and stakes.

Another area that is currently being expanded is the use of a tent structure to expand the use of vehicles. For example, it is becoming popular to use a tent structure with a camping vehicle such as a recreational vehicle or camping trailer to create more usable space. The tent structures currently being used tend to be complex and only suitable for a particular vehicle.

Another area where shelter structures are becoming popular is as temporary or semi-permanent storage facilities. Often it is desirable to store equipment, vehicles or other items in places where no permanent storage is available. However, most of these temporary structures are complex, heavy and not easily set up. Additionally, temporary shelters are used in many poverty stricken areas to provide crude, but temporary housing.

Each different use normally requires an additional shelter or tent. This can become expensive as well as requiring space for storage and transport. Additional shelters may be required if additional space is needed. Also, an existing shelter may be too large for many purposes.

Therefore it can be seen that there presently is a need for a shelter or tent support system that may be configured in many different shapes and sizes, that is easily expandable and that may be used for many different purposes.

SUMMARY OF THE INVENTION

The present invention provides a shelter or tent support system that can be easily set up in many different configurations and that is expandable. The invention provides a support system for tents, shelters and other uses that is stable in many configurations. The base assembly includes two wall supports and may be used with a fully enclosed tent cover or with shelter cover having removable panels, and also with rooms that attach to the shelter system frame.

A first embodiment of the present invention provides a base assembly to create a support system. The base assembly of this first embodiment is a flexible saddle support consisting of a plurality of shock corded sections. These sections when assembled are sufficiently flexible to form the saddle support. Two of these saddle support members are attached to a lower curved end pole segment of the base assembly whereby the base assembly further has adjustable tensor straps attached thereto that fix the span formed by the saddle support members into a free standing saddle shaped frame that forms the perimeter structure for the shelter. Between the flexible saddle support members are a plurality of spanning poles that can be attached to provide a free standing framework to which a fabric or other flexible cover may be attached to either the interior or the exterior thereof.

Another embodiment of the present invention provides removable end panels that attach to the flexible cover. The removable panels can include walls, doors, windows, screen mesh or other types of panels for use in combination with the shelter support system with the flexible cover configuration.

An additional embodiment of the present invention provides for an expandable base assembly. This is accomplished by simply adding sections to the original base support assembly. Also, additional base assembly sections may be added to this first base assembly that create additional rooms or sections. This allows for the connecting of additional modular shelters to create additional compartments that are in communication with one another.

These and other features are evident from the ensuing detailed description of the embodiments and from the drawings.

DETAILED DESCRIPTION OF THE INVENTION

Figure 1:
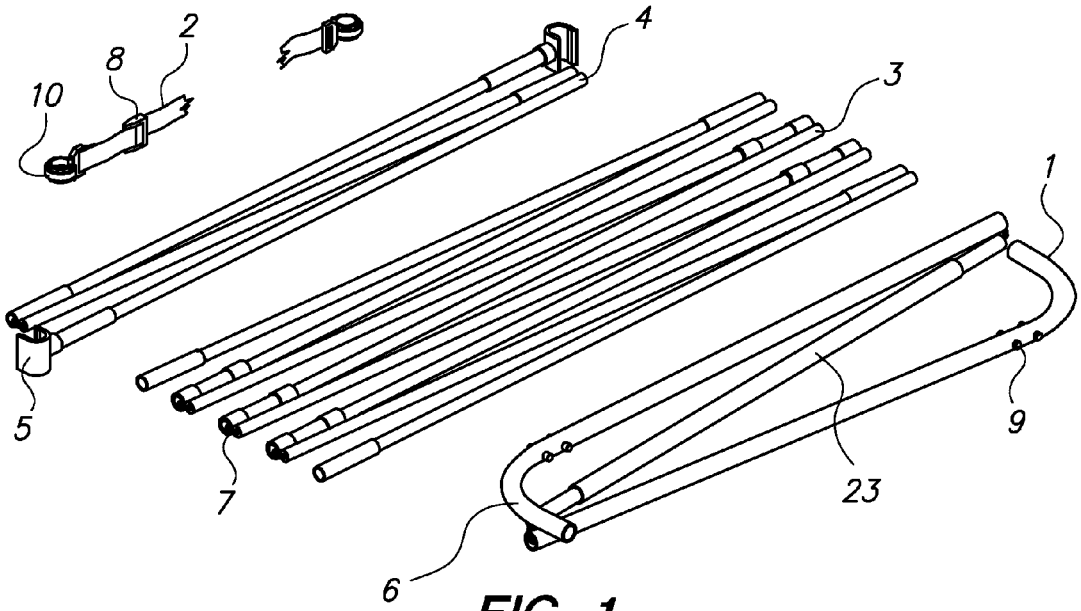
FIG. 1 is an elevated view of the shelter frame parts.
Figure 2:
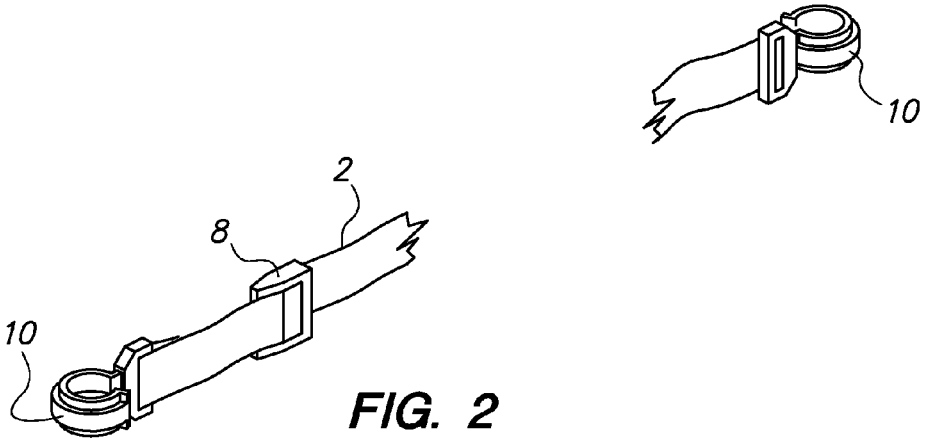
FIG. 2 is a view of the shelter frame adjustable tensors with attachment clip.

Referring to FIG. 1 in detail, the base assembly 1 consist of multiple sections including at least a first base member leg and a second base member leg where each of the base members has a straight, middle or center section 23 and two, approximately 90 degree formed, curved end sections 6. It is understood that this portion of the base assembly can be formed of as little as two pieces, that is, two base member leg sections each having a middle length with a curved section on each end. However, the multiple piece configuration allows for a larger footprint combined with the ability to pull apart and compact the system. Also, the end pieces can be formed to bend degrees other than 90 degrees in order to accommodate various design criteria and specification.

In the present embodiment, the base assembly consists of two legs where each of these legs are formed by a straight section and two swaged or curved end sections which are held in place by compression where the compression is provided by elastic cord, or shock cord, that allows the curved end sections and the straight middle sections to basically self assemble. Rivets 9 on the curved end sections are used as a restraint mechanism to locate and accommodate tensor clips 10 and to further prevent slippage of the clips on the curved end sections 6. The curved end sections 6 are free to rotate 360 degrees and accept the flexible support members 3, or saddle pole ends in a male/female union. The freely rotating curved end section 6 allows the shelter support system to be flexible when deflected without strain or bent and broken parts. It is understood that the curved end section 6 function can be accomplished using alternative means, and for purposes of brevity the preferred embodiment exploration of these means will be limited to the described reference.

The base assembly also includes tensor straps 2. In further detail the tensor straps 2 consist of a flat webbing strap, connector clips 10 on each end and a length adjustment mechanism 8. The tensor straps 2 restrain the flexible support members tension created by the forming of the saddle and allow final adjustment to perfect the zipper tension of the end panels 10. As demonstrated with the cover 14, this adjustment provides for a tighter or looser fitting cover 14 when the shelter support system is fully assembled. It is understood that the tensor strap 2 function can be accomplished using alternative means, such as wire rope or tubing, and for purposes of brevity the preferred embodiment exploration of these means will be limited to the described reference.

In further detail, the saddle poles, or flexible support members 3 consist of multiple shock corded sections with locating restraints 7 to accept at least one spanner pole 4 by way of end clips 5 at determined locations. The flexible support member ends slip fit into the curved end sections 6 to form a secure tubing union. It is understood that the flexible support members function can be accomplished using alternative means, and for purposes of brevity the preferred embodiment exploration of these means will be limited to the described reference.

Figure 3:
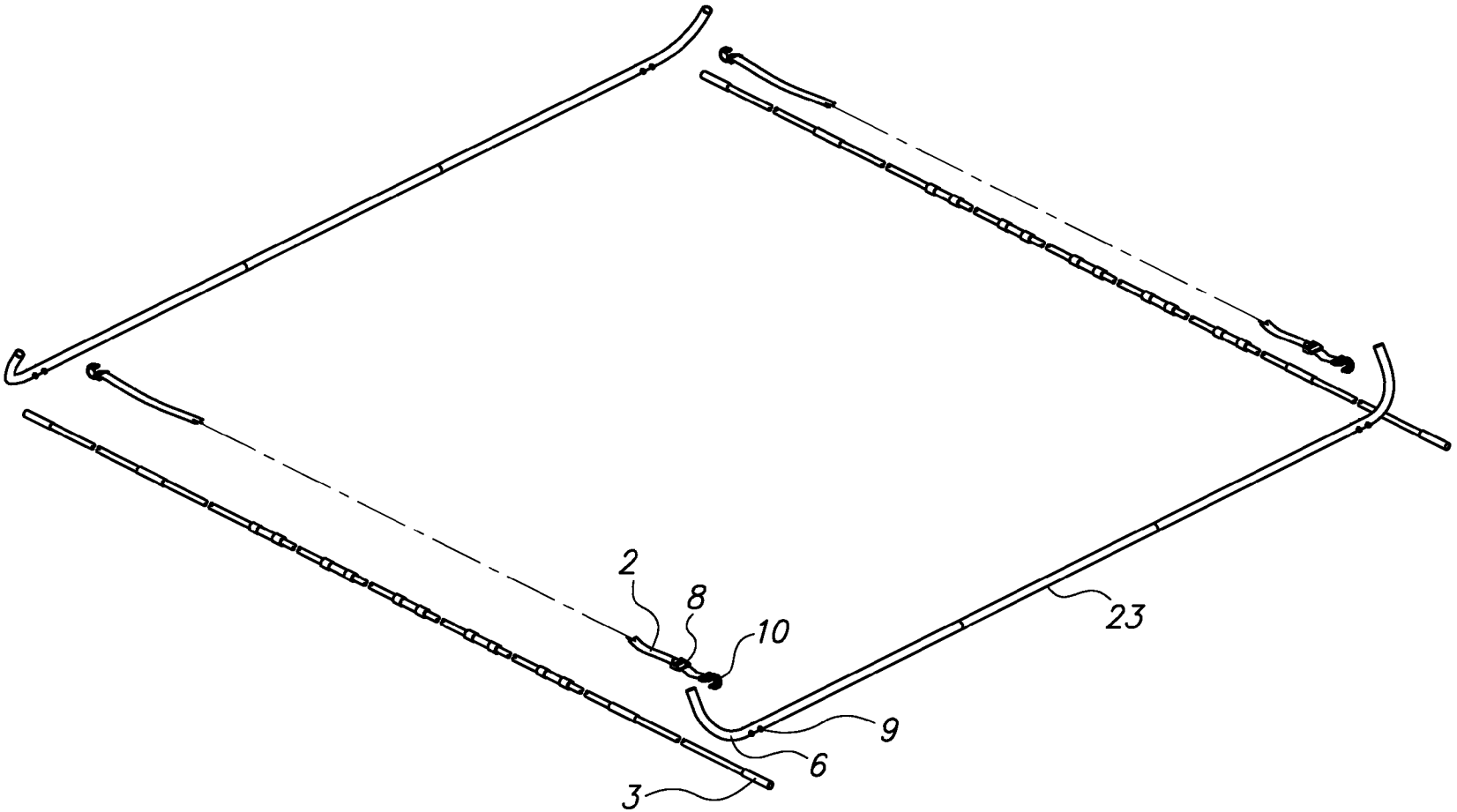
FIG. 3 is a perspective view of the shelter base assembly positioned for assembly.
Figure 4:
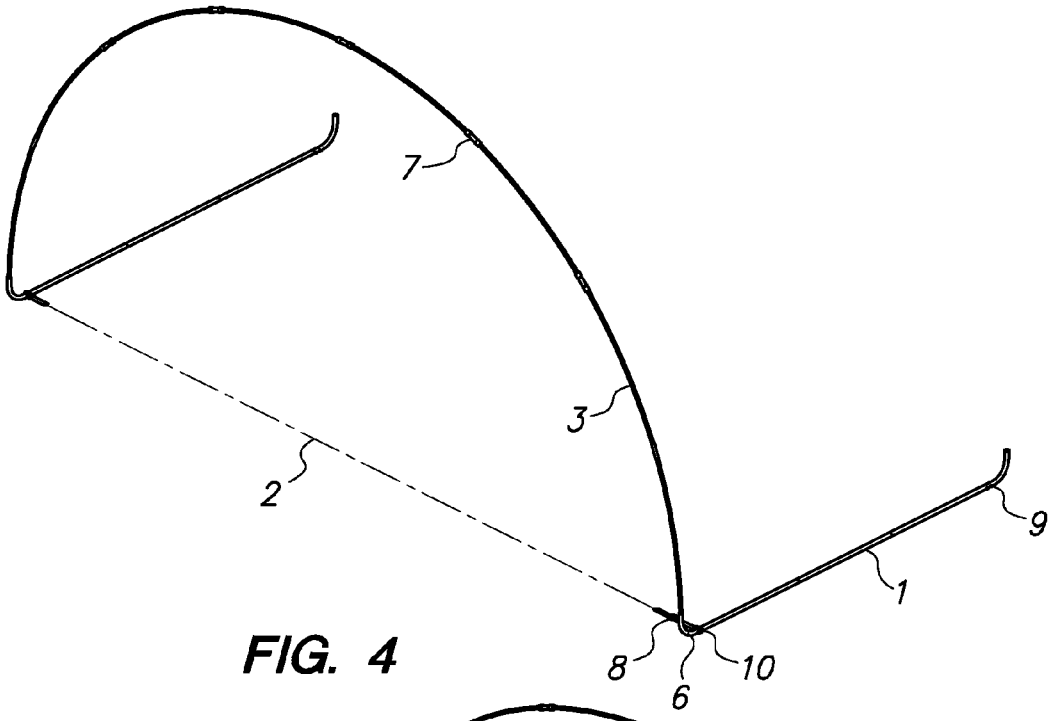
FIG. 4 is a perspective view of the shelter partially assembled free standing frame.

Referring to FIG. 3 the ground pieces of the base assembly are shown expanded and ready for assembly. As can be seen in this FIG. 3 the middle straight section 23 is already interconnected with curved end sections 6 forming one, assembled leg of the base. These end base sections are then placed facing each other, ready for acceptance of connectable tensor straps 2. Flexible support members 3 are inserted into facing curved end sections after which the end sections are then connected using tensor straps 2, as shown in FIG. 4. This same operation is performed with a second flexible support member 3 such that when all are interconnected the flexible members are flexed into shape with the resultant form being a self supporting arch, as shown in FIG. 5.

Referring to FIG. 4 the free standing shelter support system is shown with one flexible support member 7 fitted to the curved end sections 6 with the result being a free standing partial frame. The shelter support system geometry is such that this partial free standing frame is compliant with single person setup and takedown of the frame.

Figure 5:
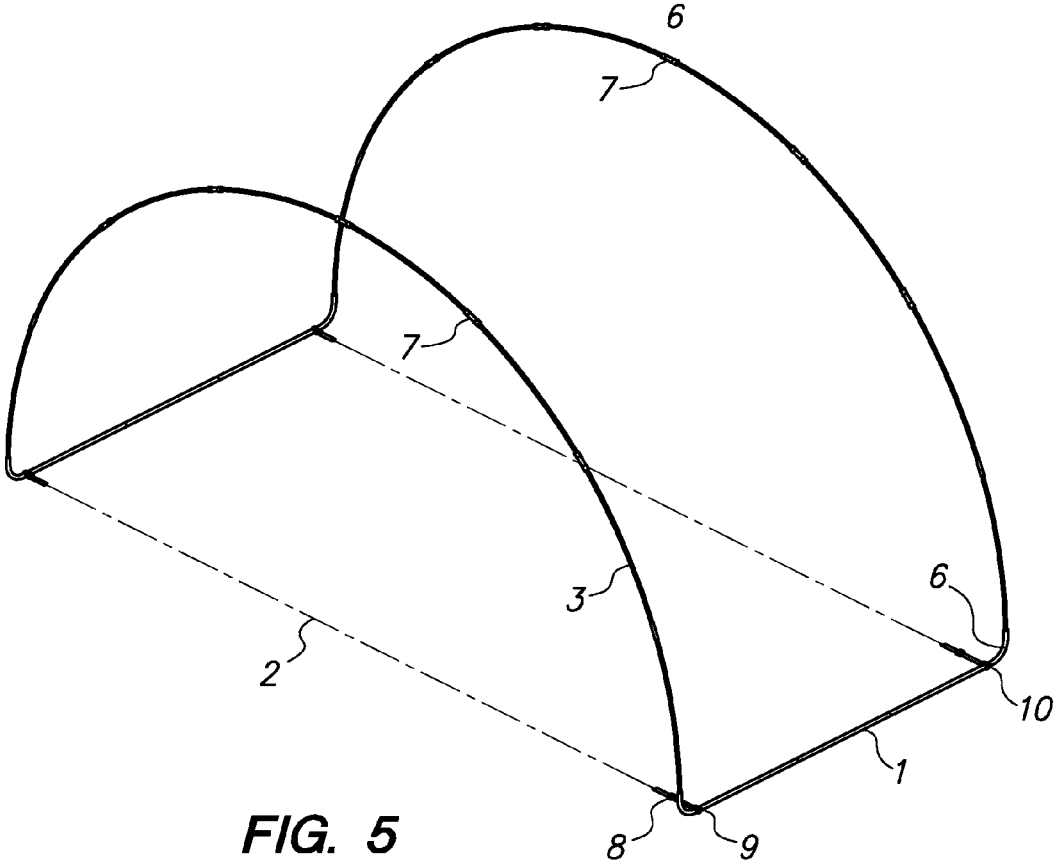
FIG. 5 is a perspective view of the shelter frame saddle assembled.

Referring to FIG. 5 the second flexible support member 7 is now in place with the tensors straps 2 clipped to the curved end section 1 using clips 9 and rivets 10, providing a free standing arched shelter support system structure.

Figure 6:
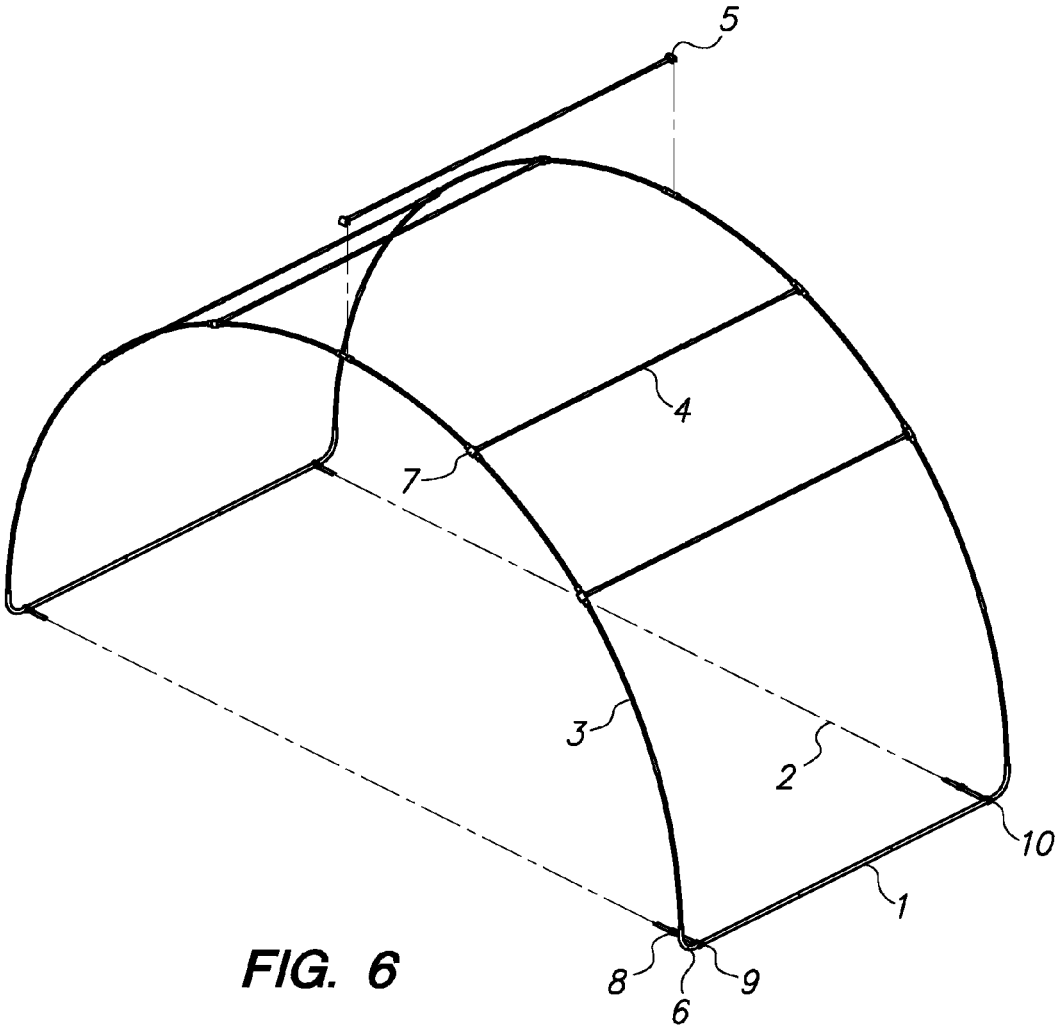
FIG. 6 is a perspective view of the shelters frame fully assembled.

Referring next to FIG. 6 a plurality of spanner poles 4 are now clipped onto the flexible member poles 3 using spanner clips 5 at predetermined locations 7 as shown in FIG. 1. The 180 degree saddle or arch is held in a fixed width dimension by the adjustable tensor stays 2 that are removably attached to the curved end sections 6, thereby arresting the flexible support members 3 spring tension in a fixed width to form the assembled shelter support system.

Figure 7:
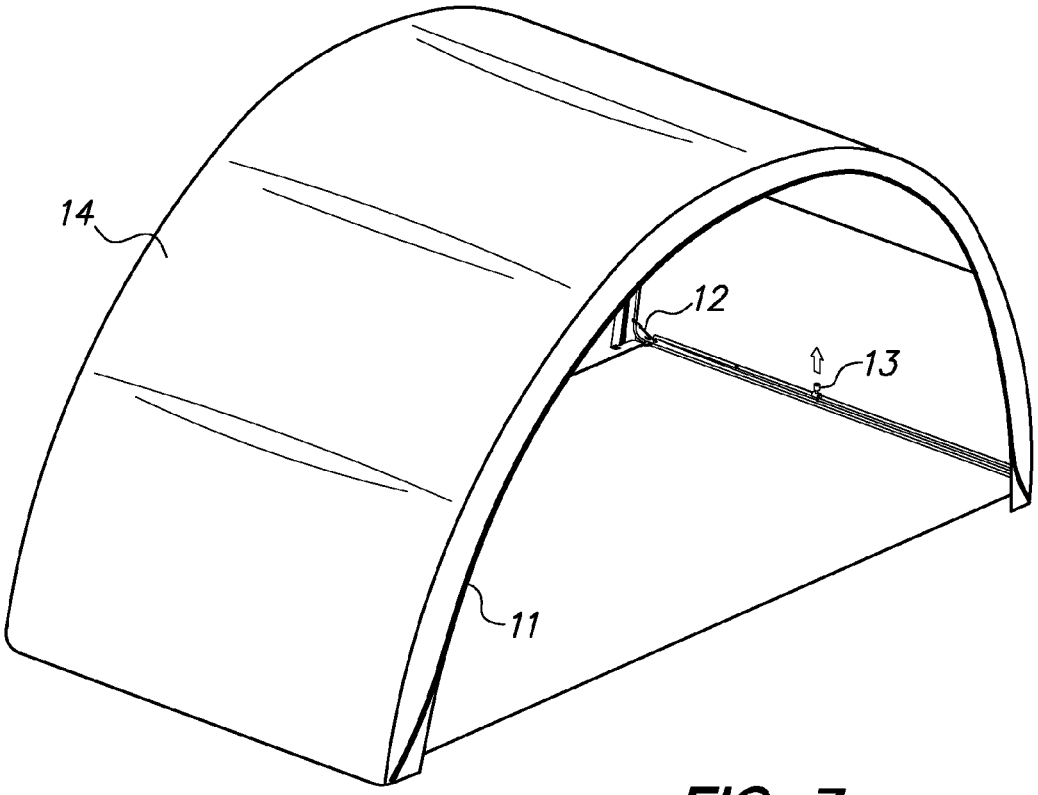
FIG. 7 is a corner view of the shelter frame of FIG. 6 with a fabric cover installed.
Figure 8:
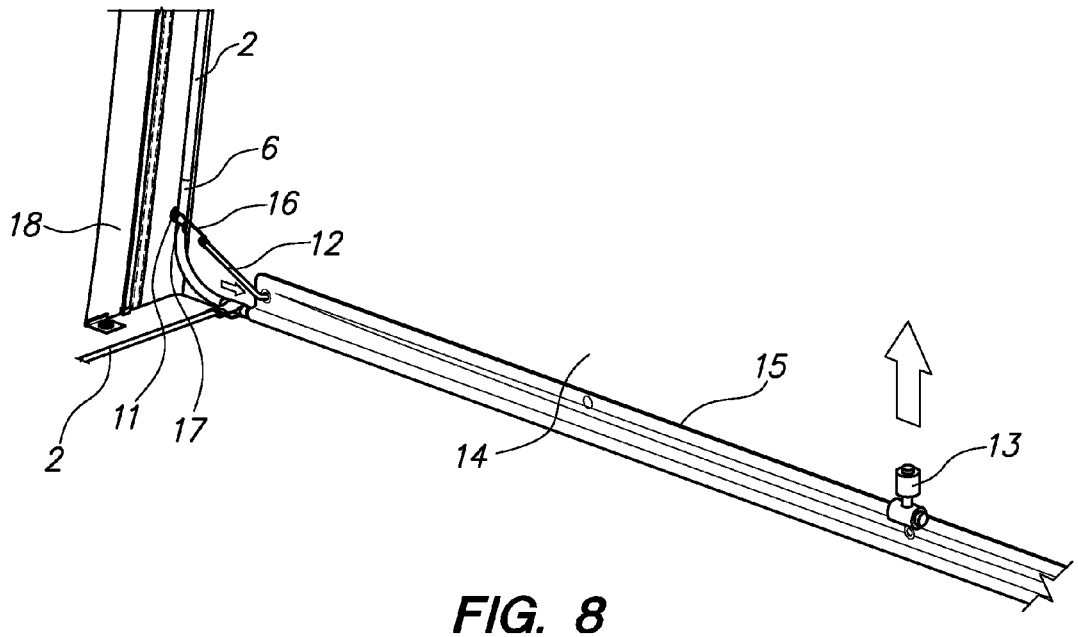
FIG. 8 is a perspective view of the shelter systems tension system and corner view.

Referring to FIG. 7, a cover 14 is shown applied over the frame set in FIG. 6 such that when the cover is in place the structure has open ends that allow for the attachment of end panels and other modular connection pieces. Further, this cover contains a cord whereby the cord may be elastic, non-elastic or it may be a combination of non-elastic cord 11 and elastic cord 12 sewn in its perimeter edge, so that the installed cover can be tensioned in a 360 degree manner inside the saddle perimeter 19, and under the curved end section, as shown in FIG. 8. This cover can be opaque, transparent, translucent, insulated, netted or mesh fabric. The corner detail of this 360 degree tensioning system can be seen in FIG. 9. It is understood that the 360 tension function can be accomplished using alternative means, and for purposes of brevity the preferred embodiment exploration of these means will be limited to the described reference.

FIG. 8 shows the saddle with a flexible cover attached. Also when referring to FIG. 8, an end view of the inside of the cover's return flap 15 can be seen. FIG. 8 also demonstrates the details of the support system's modularity, exhibited by the 360 tension system cordage in the bottom of the return flap 15, with a zipper connection above it for the modular weatherproof connector 26 and a zipper on top for the attachment and detachment of various end panels. This tensioning system will be described next.

The tensioning system of the present invention is unique and provides multiple advantages. The system provides a method and means to securely affix the cover to the saddle. However, it also provides a stabilizing effect to the entire system. It also provides an efficient system of adding compartments to the existing arch.

Figure 9:
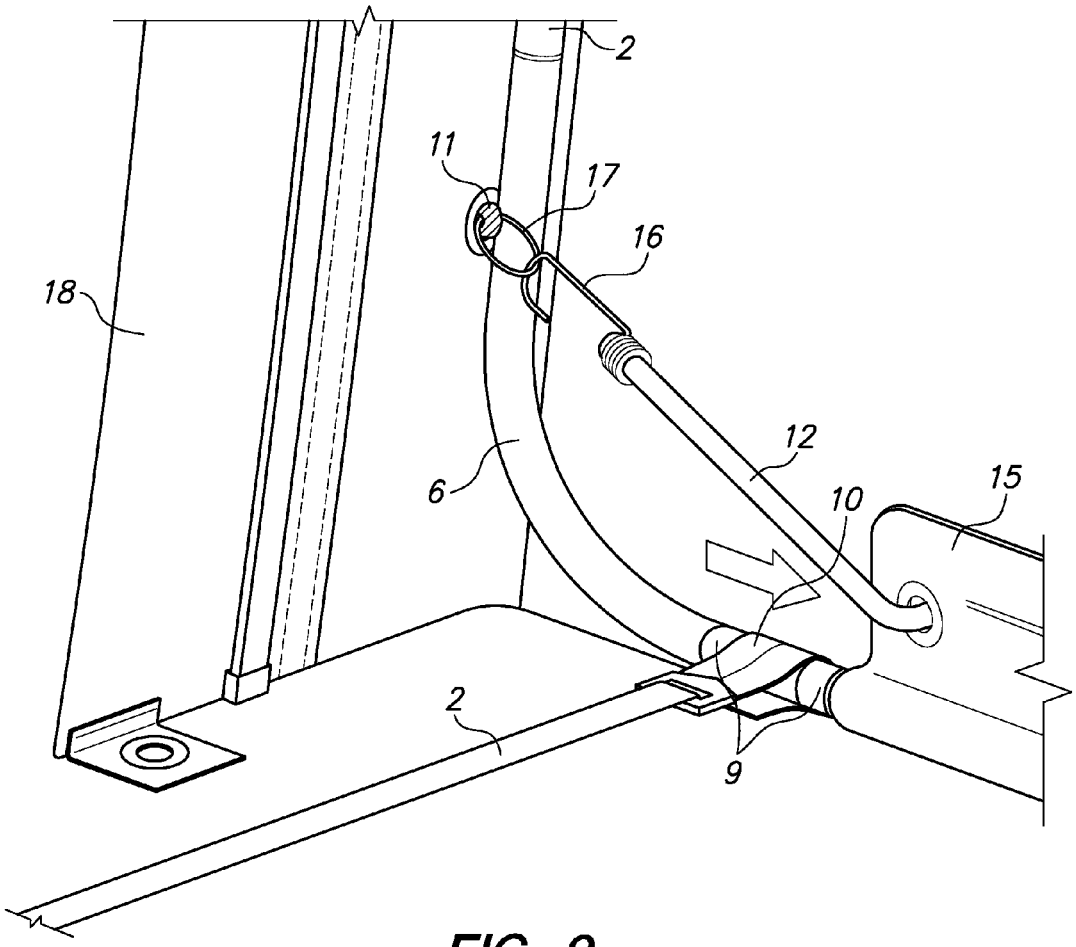
FIG. 9 is a perspective corner view of the shelter's 360 degree tensioning device and corner structure.

One means of accomplishing the shelter support systems 360 tension system is shown in FIGS. 8 and 9. In this configuration the shelter support system's base assembly has a cover, or base assembly wrap 15. This wrap is accomplished by pulling the lower cover section around the base assembly straight section so that the wrap is clipped to the inside of the cover creating a pocket in which the entirety of the base assembly straight, and or flat sections between the tensioning clips is contained. Once in place a mechanical cinch 13 permits the intermediate adjustment of an elastic cord 12 that runs through the shelter support systems cover base assembly wrap 15, with the adjustment connected to an attachable clip 16 and ring 17 in four corners of the shelter system, whereby the ring 17 is attached to a non-elastic cord 11 that is sewn into the perimeter of the shelter systems cover 11.

Figure 10:
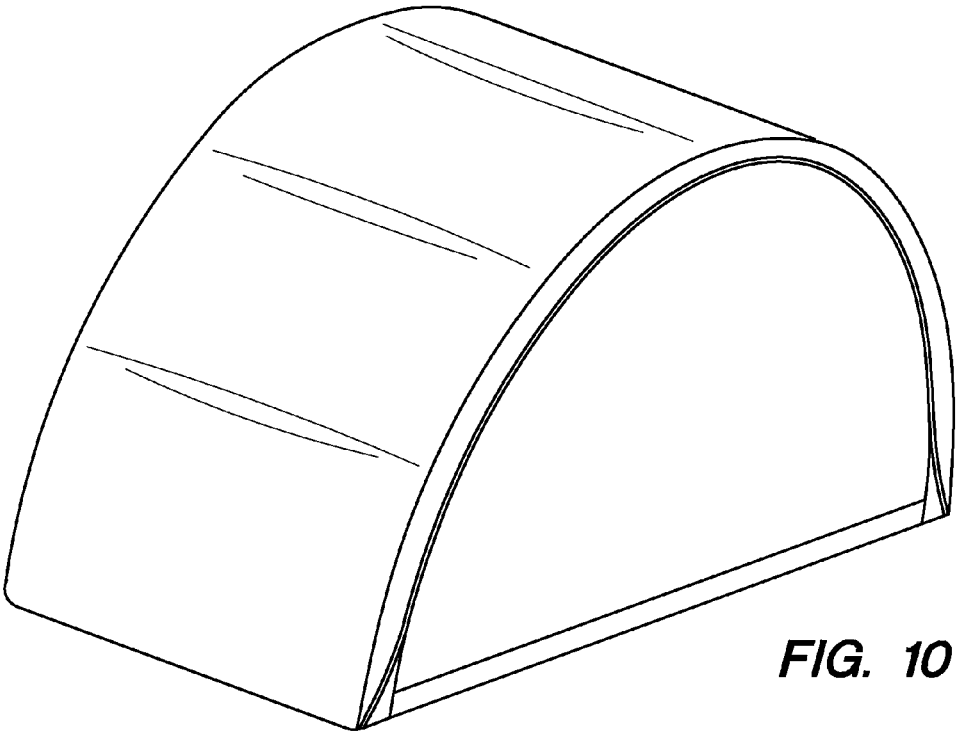
FIG. 10 is a perspective view of the shelter system with a modular solid end panel installed.

Corner details of this tensioning system are shown in FIG. 9. When the mechanical elastic tension mechanism 13 engages, the cordage embedded in the cover perimeter 11 tightens and tensions the cover around and to the shelter support systems frame, as shown in FIG. 10, thus providing a secure, taught cover.

Figure 11:
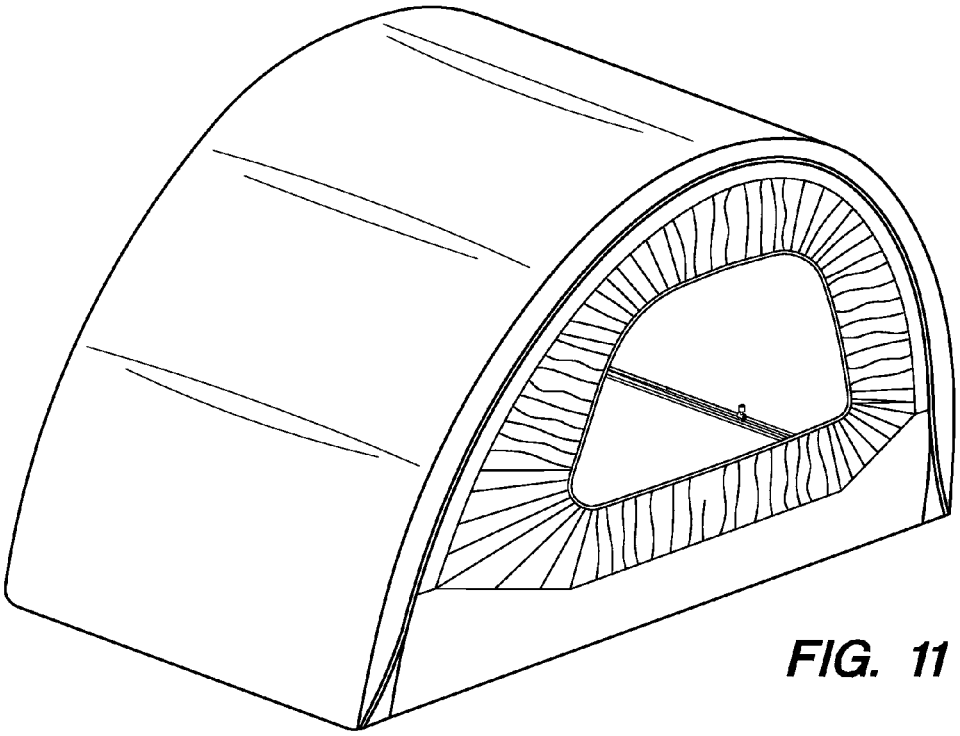
FIG. 11 is a perspective view of the shelter device of FIG. 7 with a modular elastic, connector panel installed.
Figure 12:
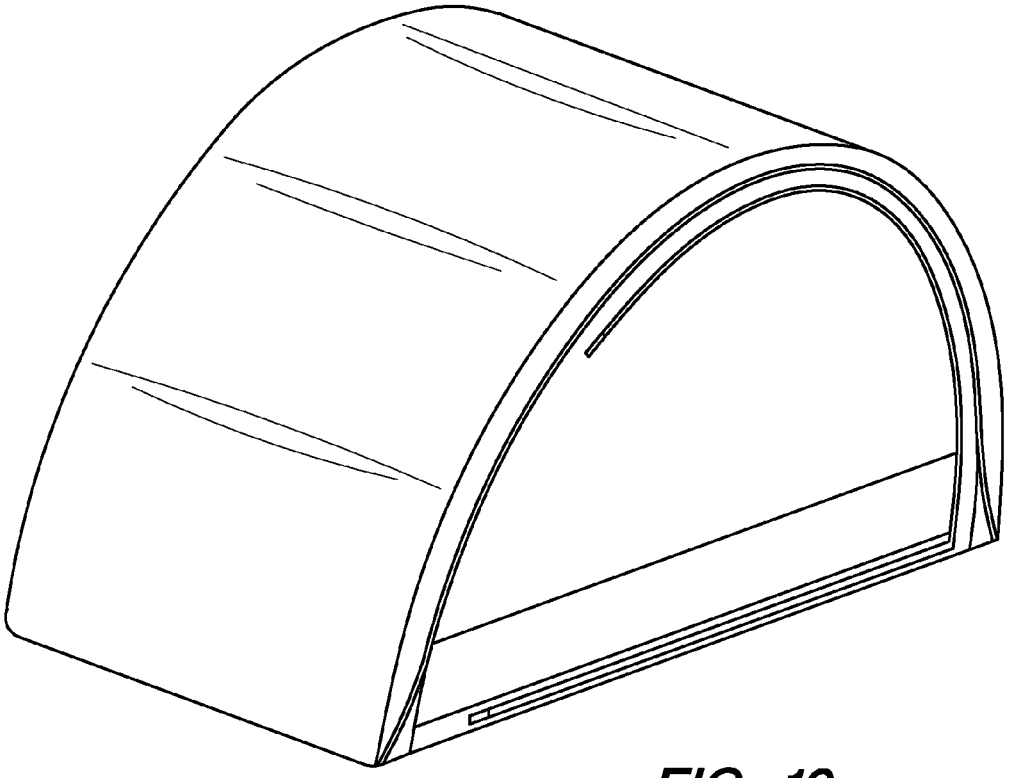
FIG. 12 is a perspective view of the shelter device of FIG. 3 with a modular combination solid panel and door panel installed.
Figure 13:
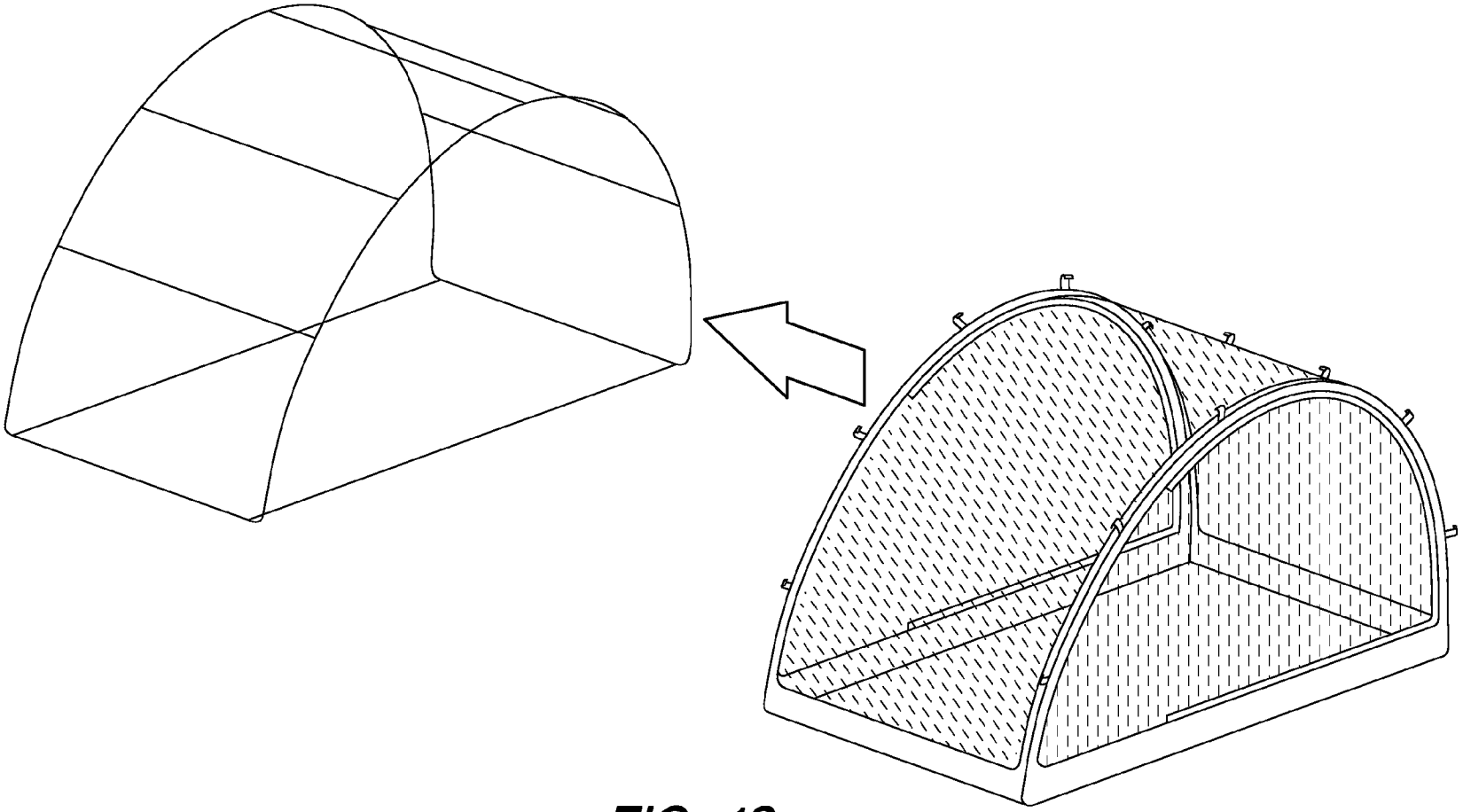
FIG. 13 is a perspective view of the shelter frame receiving a modular screen room with solid floor.
Figure 14:
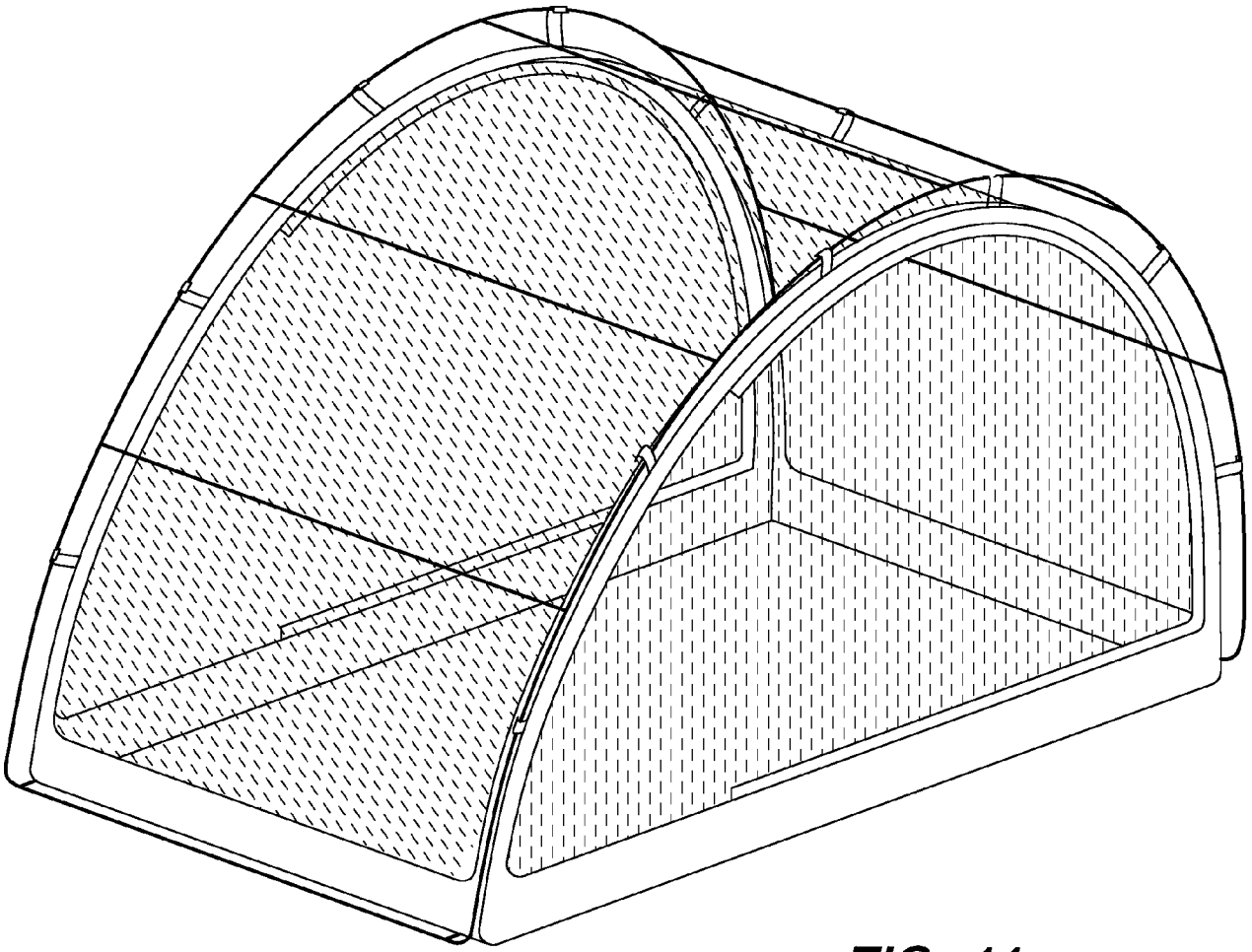
FIG. 14 is a perspective view of the shelter system frame with a modular screen room with solid floor installed.

The construction details of the invention, as shown in FIG. 7, are such that the two open ends of the modular shelter can be enclosed with modular end panels that attach onto the cover 14. FIG. 10 shows a solid panel; FIG. 11 shows an elastic, connector panel; and FIG. 12 shows a combination modular door with screen panel. The invention can modularly receive any combination of end panels 25, or be left open. Alternatively, the cover can be a mesh or screen, as shown in FIGS. 13 and 14. The modular shelter also can have a provision for a room that attaches inside the frame and the covered frame.

Figure 15:
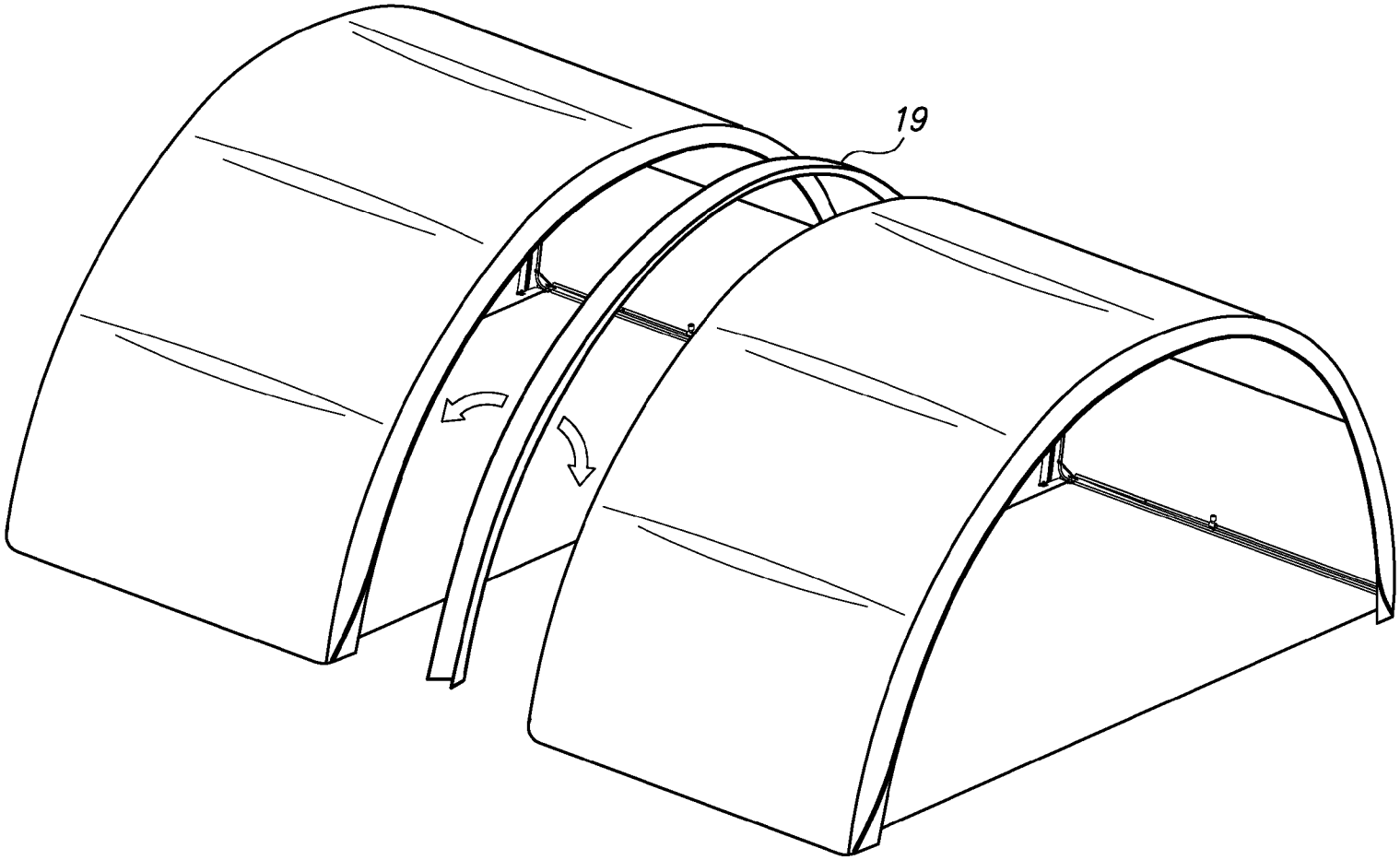
FIG. 15 is a perspective view of the modular shelter being connected to a second modular shelter device by way of a weatherproof modular connector.

Referring now to FIG. 15, the invention is shown as a modular shelter section that can be connected in series for larger enclosed space. This is accomplished with a double zipper connector strip 26. As these modular sections shown in FIGS. 13 and 15 are added together using zippers, hook and loop, or other common connection methods the end panels, along with the clip in room, shown in FIGS. 13 and 14, can be selectively added or removed to enhance the overall function of the modular shelter. Further, each connection is weatherproof and allows for the entry and egress at each weatherproof connector 26 location, essentially creating both a weatherable connection and a door. Further, when multiple shelter support systems are connected and the end panels are attached inside, the torsional rigidity of the overall structure is enhanced.

The advantages of the present invention include, without limitation, that it is portable and exceedingly easy to transport. It is easy to move these devices when assembled because they are lightweight and rigid. The present invention has unique aerodynamic characteristics that make it robust in windy conditions. And, the present invention allows for a modular usage profile so that one of the present inventions can perform many of the functions currently available only by way of multiple, separate products.

DETAILED DESCRIPTION OF ADDITIONAL EMBODIMENTS AND USES

Figure 17:
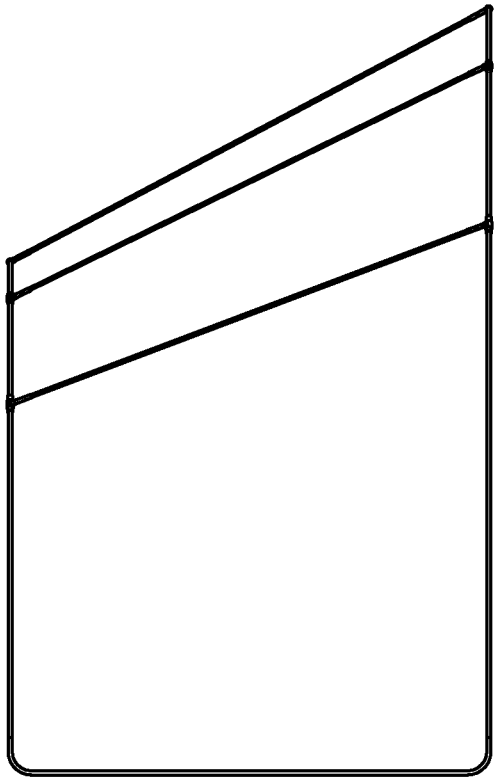
FIG. 17 is a side view of the shelter system designed in a conical shape.
Figure 20:
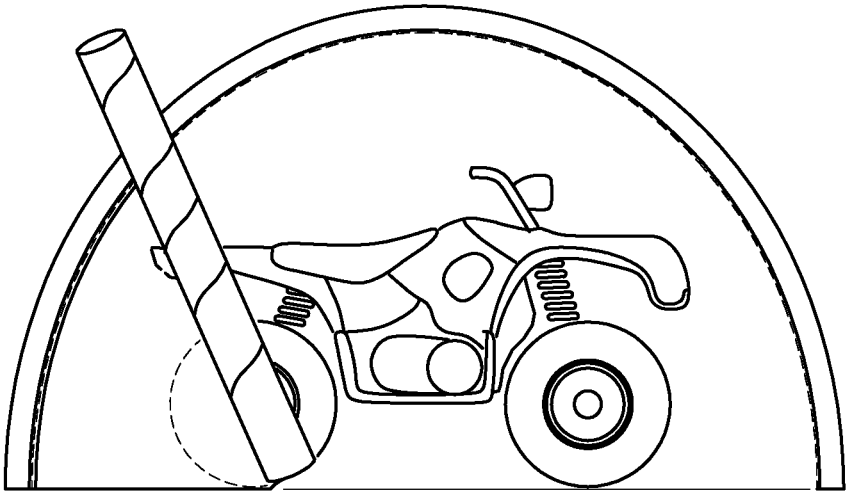
FIG. 20 is an end view of the shelter support system functioning as a portable garage.
Figure 22:
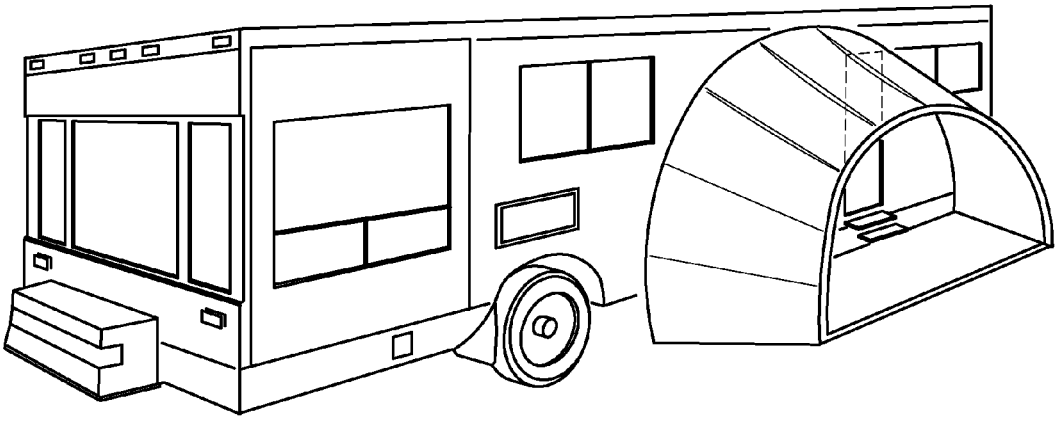
FIG. 22 is a perspective view of the shelter support system expanding the living space of an RV.

The present invention is extremely configurable to different designs. For instance, FIGS. 17 and 20 show the present invention with a first flexible support member that is shorter than a second flexible support member thus forming a conical shaped version of the shelter support system. This can be used for example, as shown in FIG. 22, as an entry cover for an RV. The conical shape provides a unique shape along with the added benefit of providing rain and debris shedding abilities.

As described above, the flexible support members 3 and lower curved end sections 6 form a simple, yet extremely stable tent support system in the shape of a saddle or arch. The system may be used freestanding without the need of a cover material to control its shape; however, the shelter cover material may be quickly and easily attached to the shelter support system, as shown in FIG. 7. The shelter cover covers the saddle support members and spanner poles and does not need a mechanical attachment to the shelter because of the 360 tension system design described above. However, the cover can include mechanical attachments, like hook and loop fasteners, c-clips or any other type of fastening mechanisms. In one embodiment the lower cover section is wrapped around the lower end curved end section members and over the saddle support members with the cover perimeter 18 forming a smaller perimeter than the saddle frame members, formed by the flexible support members. The edge of the cover perimeter 18 contains a closed sleeve with cordage 19 inside that extends down into the four corners of the shelter where the cordage ends are exposed 11. A cordage connecter 17 allows for the elastomeric cordage 12, attached to the tensioning mechanism 13 in the cover ends, that wrap around cover end flap 15 the curved end sections to connect to the perimeter cordage 19 and uniquely tension the entire cover over and onto the shelter support system frame, as shown in FIG. 7. The cover perimeter 18 that extends inside the saddle frame tubes, as shown in FIG. 16, contain connector devices 21 and 22 that allow for the attachment of end panels containing doors, windows, screens . . . ect., and that also permit the attachment of weatherproof connector 26 pieces for joining one shelter support structure to another.

Figure 16:
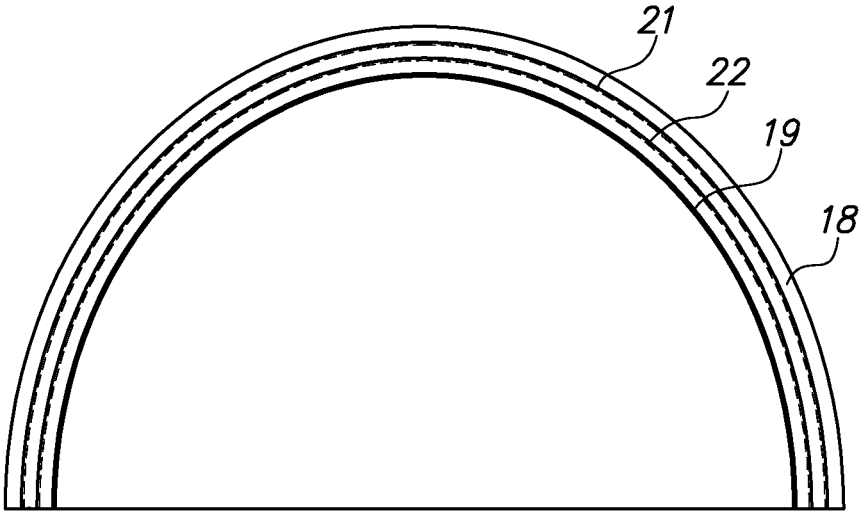
FIG. 16 is a end view of the inside of the shelters cover perimeter that includes the 360 tension system and attachments for modular end panels and weatherproof connectors.

In a second embodiment, the shelter includes a series of attachment mechanisms 21 and 22, shown in FIG. 16, for affixing end panels. This allows a panel to be entirely or partially removed to form a door or wall, or alternatively it may be replaced with a screen mesh or transparent panel. The panels may be zippered together or fastened by other fastening means. Further, the unique, open, free standing frame of FIG. 6 allows for a modular enclosed room, as shown in FIGS. 13 and 14 that is attachable to the support system when desired.

The shelter may also include a floor panel that may be fastened to the lower perimeter of the shelter cover 15, or to the curved end sections 6. This floor panel also provides a tensioning mechanism for preventing the lower ends of the flexible support members from moving in the absence of the tensors by way of tensor clips 10 being sewn to the four corners of the floor.

The shelter cover may include a screen mesh, a zippered panel, a transparent skylight panel or other variations. The present invention is designed to allow the base frame system to be used with various covers, end, floor and attachable room configurations.

Figure 18:
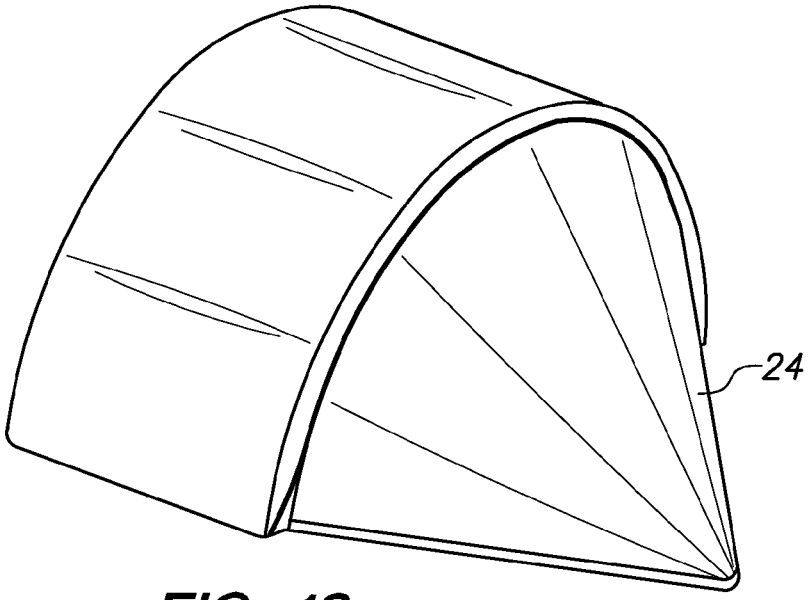
FIG. 18 is an end view of the conical shaped modular with end panel installed.

Another embodiment is illustrated in FIG. 18. This embodiment utilizes the same support structure as shown in FIG. 1 with the addition of Vestibules 24 as shown in FIG. 18, that can be attached to either end of the flexible support member cover perimeter. With the vestibule 24 attached and weighted or staked at its apex, no additional support structure is needed. Each vestibule can include doors or window flaps if desired. This provides extensive additional storage or living space that is modular. It is to be expressly understood that more than one vestibule can be used in this configuration.

Figure 19:
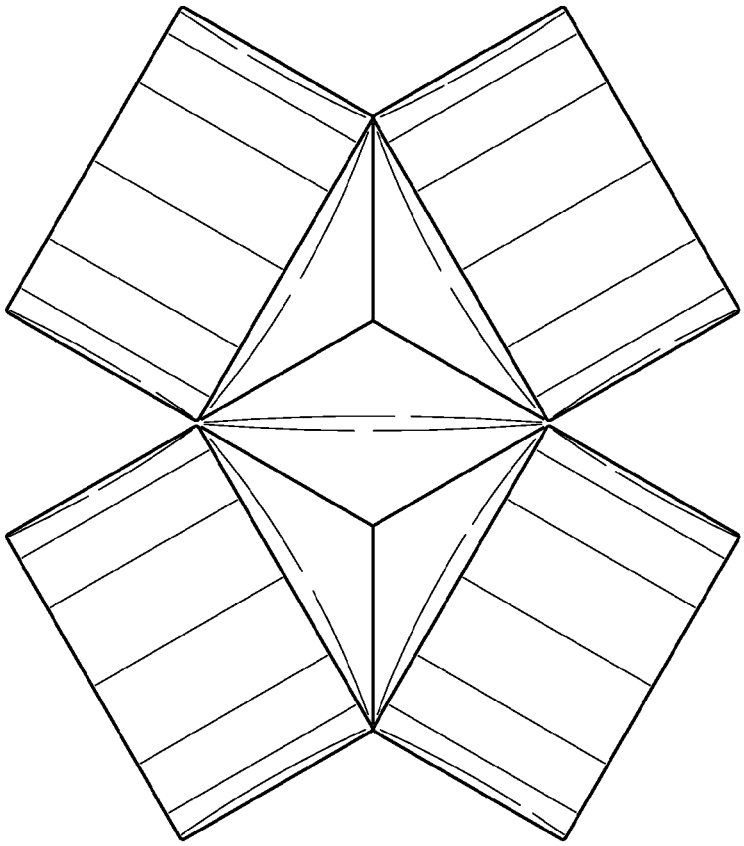
FIG. 19 is an overhead view of the four shelter support system units in cellular communication with a common hub.

Another configuration of this embodiment is illustrated in FIG. 19. The same configuration of the saddle cover perimeters as shown in FIG. 7 is used with additional flexible support members secured to the cover perimeter zipper 22 to create an additional shelter that opens into the original shelter. Additional vestibules or complete shelters or weatherproof connectors 26 can be secured to any open saddle support cover perimeter 22 as well, to provide a cellular shelter structure. The open connectedness of the shelter saddle perimeter cover 18 member containing connection mechanism's 21 and 22 creates an infinite number of open or closed cellular living spaces with ingress and egress available at each weatherproof connector 26 location.

Additional support members may be added as well to create an infinite number of rooms that open into one another. For instance, the current invention is designed to seamlessly function with another common invention described in U.S. Pat. No. 8,001,987. Privacy walls may be added with doors that allow communication into and through one another. The interstitial panels, while invisible from the outside of the shelter, none-the-less have dual function as both to segmentation and strengthening, due to the shear wall rigidity function of the attachable panels.

Other Uses

Figure 21:
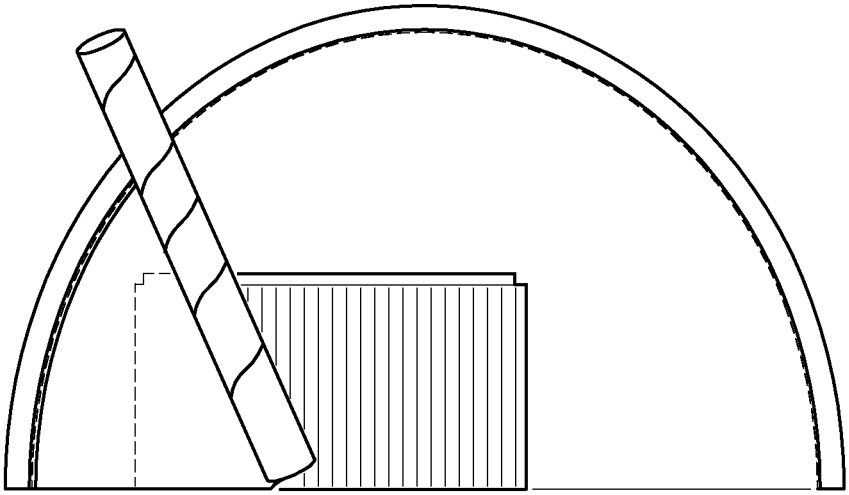
FIG. 21 is an end view of the shelter support system functioning as a hot tub enclosure.

The present invention has novel utility as a stand alone shelter as well in combination with other structures. For example and without limitation, the configuration illustrated in FIG. 7 may be used with only the top cover as an outdoor sun shelter, concession stand, trade show booth or other similar uses, such as a hot tub enclosure example shown in FIG. 21. FIG. 21 shows the shelter with an end door partially rolled open, revealing the inside of the shelter.

Another use for which the present invention is particularly suited is equipment storage. One example of this is illustrated in FIG. 20. As can be seen, equipment, such as all terrain vehicles and other valuable items, may be stored within. There is often insufficient storage space for this type of equipment at home, thus requiring equipments to be stored outside, uncovered. This creates an unsightly appearance in residential areas as well as security issues. The shelters of the present invention provide a place to store and protect the equipment from environmental damage, as well to hide their appearance. These same storage issues also occur during use of this type of equipment. It is often desirable to store this equipment while camping, hunting or while on other expeditions. The present invention enables private storage in a weather resistant manner.

The present invention may also be expanded for use as semi-permanent storage shelter, such as a garage. Flexible support members are ganged together to provide a longer structure. Also, the tubing used in the flexible support members may be of a larger diameter and thicker gauge to support a heavier cover material, including solid and/or, flexible sheets.

The present invention may also be used in combination with other types of camping and traveling equipment. For example, as shown in FIG. 22, the saddle support connector panel may be used for attachment alongside a recreational vehicle door (RV). This provides a shelter that may have the sides opened with or without a screen to create a patio for the RV. This allows for additional living space within a relatively private shelter outside of the RV.

Figure 23:
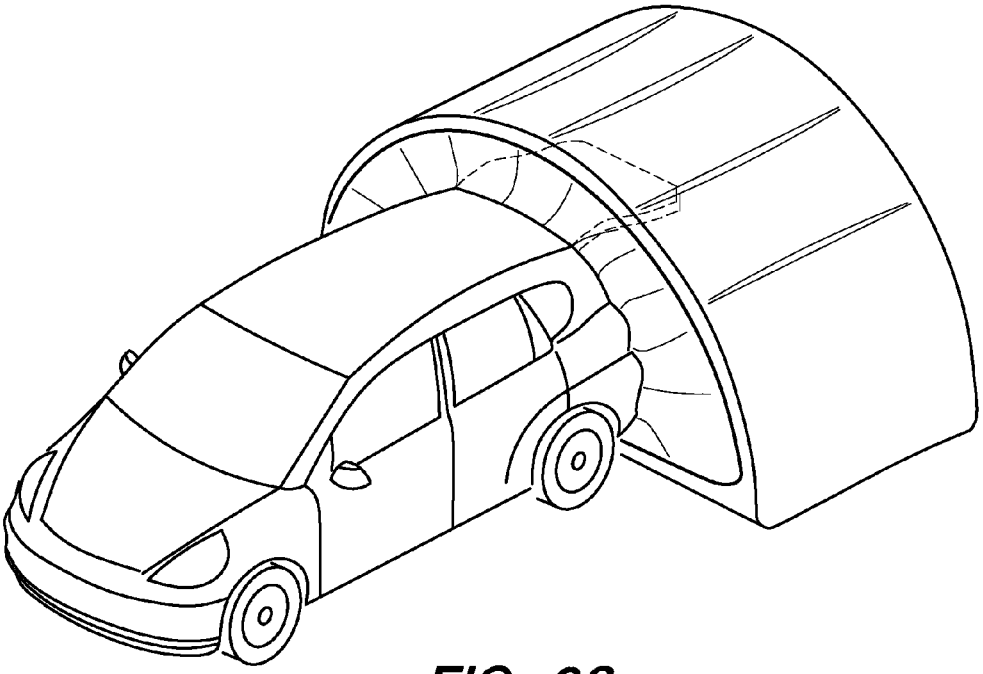
FIG. 23 is a side view of the shelter support system expanding the living space of an SUV.

FIG. 23 illustrates another configuration of the preferred embodiment of the present invention. This configuration illustrates the utility of the shelter system to be used with a vehicle such as a sports utility vehicle, van, or other types of vehicles. The attachable connector panel has an elastic sock that stretches around vehicle doors and liftgates to provide a weatherable connection to the vehicles interior. This allows the vehicle interior to be in direct communication with the tent or shelter.

It is to be expressly understood that the above embodiments are for explanatory purposes only and are not meant to limit the scope of the claimed inventions. Other embodiments of the present invention are considered within the scope of the claims.

What is claimed is:

1. A shelter system comprising:

a base assembly comprising:

a first base member having a straight middle section, a first curved end section and a second curved end section;

a second base member having a straight middle section, a first curved end section and a second curved end section;

at least a first adjustable tension strap and a second adjustable tension strap; and an affixing means to secure ends of said first tension strap to said first curved end section of said first base member and said first curved end section of said second base member and a second affixing means to secure ends of said second tension strap to said second curved end of said first base member and said second curved end of said second base member;

a flexible support assembly attachable to said base assembly comprising:

a first flexible support member where a first end of said first flexible support member is securable to said first curved end section of said first base member and a second end of said first flexible support member is securable to said first curved end section of said second base member;

a second flexible support member where a first end of said second flexible support member is securable to said second curved end section of said first base member and a second end is securable to said second curved section end of said second base member;

a plurality of spanner support members that are attachable anywhere along the length of said first and said second flexible support members; and a tensioning cover, wherein said tensioning cover includes a wrap assembly wrapping around the base assembly and an adjustable means for tensioning said cover to the base assembly.

2. The shelter system of claim 1 where each of said flexible support members is configured in the shape of a saddle.

3. The shelter system of claim 1 where said first flexible support members is longer than said second flexible support member whereby the resultant shelter is conical shaped.

4. The shelter system of claim 1 where said cover is securable to said base assembly and to said flexible support assembly.

5. The shelter system of claim 1 where said cover is opaque, transparent, translucent, insulated, netted or mesh.

6. The shelter system of claim 1 where said first base member and said second base member have shock cords to assist in pulling the sections together.

7. The shelter system of claim 1 where said flexible support members have multiple sections.

8. The shelter system of claim 7 where said flexible support members have shock cords to assist in pulling the sections together.

9. The shelter system of claim 1 where the cover further includes end panels.

10. A shelter system comprising:

a base assembly comprising:

a first base member having a straight middle section, a first curved end section and a second curved end section;

a second base member having a straight middle section, a first curved end section and a second curved end section;

at least a first tension strap and a second tension strap;

an affixing means to secure ends of said first tension strap to said first curved end section of said first base member and said first curved end section of said second base member and a second affixing means to secure ends of said second tension strap to said second curved end section of said first base member and said second curved end section of said second base member;

a flexible support assembly attachable to said base assembly comprising:

a first flexible support member where a first end of said first flexible support member is securable to said first curved end section of said first base member and a second end of said first flexible support member is securable to said first curved end section of said second base member;

a second flexible support member where a first end of said second flexible support member is securable to said second curved end section of said first base member and a second end is securable to said second curved end section of said second base member;

a plurality of spanner support members that are attachable anywhere along the length of said first and said second flexible support members; and a tensioning cover system comprising a cover that wraps around and covers said first base support member, said second base support member, said first flexible support member and said second flexible support member, and an adjustable means for tensioning the cover on the base assembly.

11. The shelter system of claim 10 wherein said tensioning cover system further comprises:

a cord within a perimeter edge of said cover;

said adjustable means for adjusting a tension of said cord; and means for securing said cover tensioning system to said base members.

12. The shelter system of claim 11 that further includes end panels.

13. The shelter system of claim 11 where said cover is opaque, transparent, translucent, insulated, netted or mesh.

14. A shelter system comprising:

a first shelter system comprising:

a base assembly comprising:

a first base member having a straight middle section, a first curved end section and a second curved end section;

a second base member having a straight middle section, a first curved end section and a second curved end section;

at least a first tension strap and a second tension strap; and an affixing means to secure ends of said first tension strap to said first curved end section of said first base member and said first curved end section of said second base member and a second affixing means to secure ends of said second tension strap to said second curved end section of said first base member and said second curved end section of said second base member;

a flexible support assembly attachable to said base assembly comprising:

a first flexible support member where a first end of said first flexible support member is securable to said first curved end section of said first base member and a second end of said first flexible support member is securable to said first curved end section of said second base member;

a second flexible support member where a first end of said second flexible support member is securable to said second curved end section of said first base member and a second end is securable to said second curved end section of said second base member;

a plurality of spanner support members that are attachable anywhere along the length of said first and said second flexible support members;

a tensioning cover, wherein said tensioning cover includes a wrap assembly wrapping around and covering the base assembly, and an adjustable means for tensioning said cover to the base assembly;

at least a second shelter system comprising:

a base assembly comprising:

a first base member having a straight middle section, a first curved end section and a second curved end section;

a second base member having a straight middle section, a first curved end section and a second curved end section;

at least a first tension strap and a second tension strap; and an affixing means to secure ends of said first tension strap to said first curved end section of said first base member and said first curved end section of said second base member and a second affixing means to secure ends of said second tension strap to said second curved end section of said first base member and said second curved end section of said second base member;

a flexible support assembly attachable to said base assembly comprising:

a first flexible support member where a first end of said first flexible support member is securable to said first curved end section of said first base member and a second end of said first flexible support member is securable to said first curved end section of said second base member;

a second flexible support member where a first end of said second flexible support member is securable to said second curved end section of said first base member and a second end is securable to said second curved end section of said second base member;

a plurality of spanner support members that are attachable to each of said first and said second flexible support members;

a tensioning cover, wherein said tensioning cover includes a wrap assembly wrapping around and covering the base assembly, and an adjustable means for tensioning said cover to the base assembly; and a means for affixing said second shelter system to said first shelter system.

15. The shelter system of claim 14 that includes multiple shelter systems where each shelter system includes said means for affixing another shelter system to itself.

16. The shelter system of claim 14 wherein said support system further includes at least one end panel.

17. The shelter system of claim 14 wherein a perimeter of said cover contains an attachment means allowing the simultaneous attachment of both at least one end panel and a weatherable connector.

* * * * *